United States Patent [19]

Weisz

[11] 4,305,183

[45] Dec. 15, 1981

[54] COLLAR HOLDERS

[76] Inventor: Geraldine F. Weisz, 2240 Harmain Rd., Pittsburgh, Pa. 15235

[21] Appl. No.: 123,382

[22] Filed: Feb. 20, 1980

Related U.S. Application Data

[63] Continuation of Ser. No. 897,354, Apr. 18, 1978.

[51] Int. Cl.[3] ..... A44B 21/00

[52] U.S. Cl. ..... 24/331; 24/49 A; 24/49 K; 24/90 A

[58] Field of Search ..... 24/81 D, 81 CC, 81 BM, 24/81 BF, 81 F, 90 A, 49 K, 49 A, 49 KC

[56] References Cited

U.S. PATENT DOCUMENTS

| | | | |
|---|---|---|---|
| 1,347,999 | 7/1920 | Elson | 24/81 D |
| 1,350,569 | 8/1920 | Sampson | 24/81 D |
| 1,372,329 | 3/1921 | Anderson | 24/81 D |
| 1,399,389 | 12/1921 | Kapotkin | 24/81 D |
| 1,851,589 | 3/1932 | Nobbe | 24/81 D |
| 1,889,862 | 12/1932 | Kessler | 24/49 K |
| 2,161,506 | 6/1939 | De Caracena | 24/90 A |
| 2,312,890 | 3/1943 | Forstner | 24/81 D |
| 2,502,199 | 3/1950 | Berger | 24/81 D |
| 2,572,103 | 10/1951 | Borst | 24/81 D |
| 2,576,689 | 11/1951 | Lawrenz | 24/81 D |
| 3,508,041 | 4/1970 | Sweany | 24/49 A |
| 3,774,267 | 11/1973 | Sneider | 24/81 D |

FOREIGN PATENT DOCUMENTS

| | | | |
|---|---|---|---|
| 406606 | 2/1910 | France | 24/49 KC |
| 602976 | 4/1926 | France | 24/81 D |

*Primary Examiner*—Victor N. Sakran

*Attorney, Agent, or Firm*—Buell, Blenko, Ziesenheim & Beck

[57] ABSTRACT

A collar holder is provided for securely holding collar tabs and providing a decorative and ornamental effect in the form of an elongated face plate having a front and back surface, a pair of resilient jaws fixed at one end to said face plate on the back surface intermediate its length the other end of said jaws being freely movable toward and away from the back surface of said face plate adjacent its end, a plurality of interdigiting teeth on each of said jaws and the back surface of said face plate adjacent their ends, an open generally curved receptacle opening in said jaws and back surface adjacent said teeth and between said teeth and said one end of the jaws fixed to the face plate and decorative means on the top surface of said face plate.

2 Claims, 4 Drawing Figures

Fig. 1.
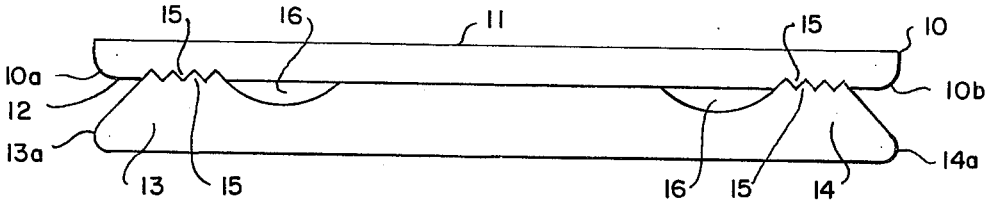
Fig. 2.
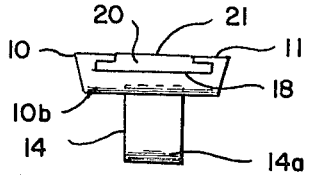
Fig. 3.
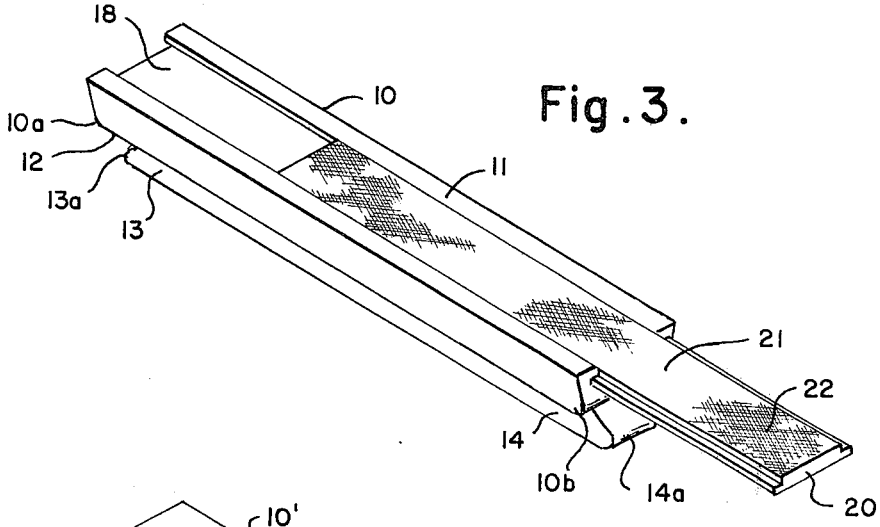
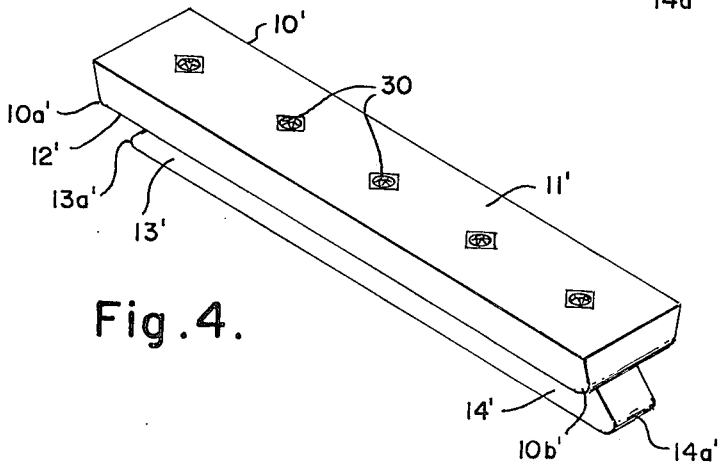
Fig. 4.

COLLAR HOLDERS

This application is a continuation of my copending application Ser. No. 897,354, filed Apr. 18, 1978.

This invention relates to collar holders and particularly to collar holders which are both utilitarian and attractive, so that they really may be considered jewelry.

Collar holders or clasps are an old and well known accessory for use by men in holding collar tabs in position and supporting a necktie. A continuing problem throughout the history of such collar holders has been that of adequately holding the collar tabs against pull-out. In addition, it is desirable that the collar holder be decorative and attractive as well as utilitarian, which the vast majority of collar holders heretofore are not.

In prior art patents the problem of holding the collar tabs is repeatedly stressed and various mechanisms proposed to solve the problem. However, my experience has been that none of the prior art devices actually solves the problem.

I provide a collar holder which does solve the problem of holding the two opposed collar tabs as well as providing a unique decorative field on the collar holder.

I provide a collar holder comprising an elongate face plate having a front and back side, a pair of resilient jaws fixed at one end to said face plate on the back side thereof intermediate its length, the other end of said jaws being freely movable toward and away from the back side of said face plate adjacent its ends, a plurality of interdigiting teeth on each of said jaws and the back side of said face plate adjacent their ends, an open generally curved receptacle opening in said jaws and back side of the face plate adjacent said teeth and between said teeth and the said one end of the jaws fixed to the face plate, and means on the front side of said face plate receiving a decorative means. Preferably the jaws are integral with the face plate but narrower than the face plate. The jaws are preferably provided with a sloping or rounded end portion, sloping away from the back side of the face plate to guide the collar tabs into the teeth and receptacle. The face plate is preferably provided with a T-slot into which interchangeable decorative elements may be inserted, such as cloth material, jewels, semi-precious stones, initials, etc. The decorative elements could be fixed directly to the face plate with the use of a T-slot.

In the foregoing general description certain objects, purposes and advantages of this invention have been set out. Other objects, purposes and advantages of this invention will be apparent from a consideration of the following description and the accompanying drawings in which:

FIG. 1 is a side elevation of a collar holder according to this invention;

FIG. 2 is an end elevational view of the collar holder of FIG. 1;

FIG. 3 is an isometric view of the collar holder of FIG. 1, partly exploded; and FIG. 4 is an isometric view of a second embodiment of this invention.

Referring to the drawings, there is illustrated a face plate 10 having a top surface 11 and bottom surface 12. The embodiment illustrated is made of a resilient plastic and is provided with integral jaws 13 and 14 extending from the mid point of the bottom surface of face plate 10. Each of the jaws 13 and 14 and the bottom surface of the face plate adjacent each end is provided with teeth 15 which interdigit between jaws and face plate. A rounded receptacle 16 is provided adjacent each set of teeth 15 between jaws 13 and 14 and the bottom surface 12 of the face plate. The receptacle 16 is of such size that the material at the binding seam around the collar tab will fit therein thereby retaining more firmly the two collar tabs. The bottom end corners 10*a* and 10*b* of the face plate are rounded and the ends 13*a* and 14*a* of jaws 13 and 14 are beveled away from the bottom surface 12 to permit ease of insertion of the collar tabs between jaws 13 and 14 and bottom surface 12.

In the embodiment of FIGS. 1 through 3, the top surface 11 is provided with an inverted T-slot 18 which interchangeably receives a slide member 20 whose surface 21 carries a decorative or ornamental device. In the illustrated embodiment surface 21 is a laminated cloth 22 similar to or contrasting with the cloth of the shirt. The slide member could be provided with jewels, semi-precious stones, laminated glitter or any of a variety of decorative materials.

In the embodiment of FIG. 4, there is provided a structure identical with that of FIGS. 1–3 except the T-slot and slide member are omitted and, in the embodiment illustrated, jewels 30 are set in the top surface 11'. All parts which are structurally the same as those of FIGS. 1–3 are given like numbers with a prime sign.

The plastic used in making the collar holder may be multi-toned in color, or single toned or clear or the face plate may be of one color and the jaws of a different color. The possible variations are, of course, legion, limited only by the designer's imagination.

In the foregoing specification, certain preferred practices and embodiments of this invention have been disclosed, however it will be apparent that this invention may be otherwise embodied within the scope of the following claims.

I claim:

1. A collar holder comprising an elongate face plate having a front and back surface, a pair of resilient jaws fixed at one end to said face plate on the back surface intermediate its length the other end of said jaws being freely movable toward and away from the back surface of said face plate adjacent its ends, a plurality of interdigiting teeth on each of said jaws and the back surface of said face plate adjacent their ends, an open generally curved receptacle opening in said jaws and back surface adjacent said teeth and between said teeth and said one end of the jaws fixed to the face plate, the top surface of the face plate being provided with a T-slot, and interchangeable slide means carrying decorative and ornamental subject matter slidably received in said T-slot.

2. A collar holder as claimed in claim 1 wherein the decorative and ornamental material is a cloth sheet laminated in clear plastic on said slide member.

* * * * *